US005094211A

United States Patent [19]

Mahnke et al.

[11] Patent Number: 5,094,211

[45] Date of Patent: Mar. 10, 1992

[54] AUTOMOTIVE FUEL RAIL ASSEMBLIES WITH INTEGRAL MEANS FOR MOUNTING FUEL REGULATOR

[75] Inventors: Randall M. Mahnke, Newport News; Michael J. Hornby, Yorktown, both of Va.

[73] Assignee: Siemens Automotive L.P., Auburn Hills, Mich.

[21] Appl. No.: 587,915

[22] Filed: Sep. 25, 1990

Related U.S. Application Data

[62] Division of Ser. No. 250,056, Sep. 28, 1988, Pat. No. 4,991,556.

[51] Int. Cl.[5] ..... F02M 41/00

[52] U.S. Cl. ..... 123/463; 123/456; 123/467

[58] Field of Search ..... 123/456, 463, 468, 469, 123/467, 447

[56] References Cited

U.S. PATENT DOCUMENTS

| | | | |
|---|---|---|---|
| 1,148,568 | 8/1915 | Bees | 137/510 |
| 3,100,502 | 8/1963 | Ford | 137/510 |
| 4,403,586 | 9/1983 | Taniguchi | 123/509 |
| 4,608,957 | 9/1986 | Kemmner | 123/447 |
| 4,653,528 | 3/1987 | Field | 123/468 |
| 4,729,360 | 3/1988 | Fehrenbach | 123/456 |
| 4,741,315 | 5/1988 | Fehrenbach | 123/467 |
| 4,844,036 | 7/1989 | Bassler | 123/456 |
| 4,869,286 | 9/1989 | Williams | 137/510 |

*Primary Examiner*—Carl Stuart Miller

*Attorney, Agent, or Firm*—Russel C. Wells; George L. Boller

[57] ABSTRACT

Fuel rail assemblies for supplying fuel to injectors of internal combustion engines include mounting structure to integrally mount a fuel pressure regulator. An annular chamber, in fluid communication with the fuel passageway of the fuel rail, is defined between a mounting section of the fuel rail and a lower housing portion of the regulator. Apertures in the lower fuel rail housing portion thus allow fuel to flow into the regulating chamber of the fuel regulator from the defined annular chamber. In some preferred embodiments, the integral mounting structure includes a mounting cup having an upper cup section and a lower tail section for receiving a fuel pressure regulating and thus regulate upstream fuel pressure within the fuel rails. Fluid communication is established between the fuel rail and the cup section of the mounting cup while fluid isolation between the cup and tail sections of the mounting cup is established by suitable seal structures. Thus, fuel enters the cup section from the fuel rail and is forced to flow through the fuel pressure regulator by virtue of the fluid isolation established between the cup and tail sections.

5 Claims, 8 Drawing Sheets

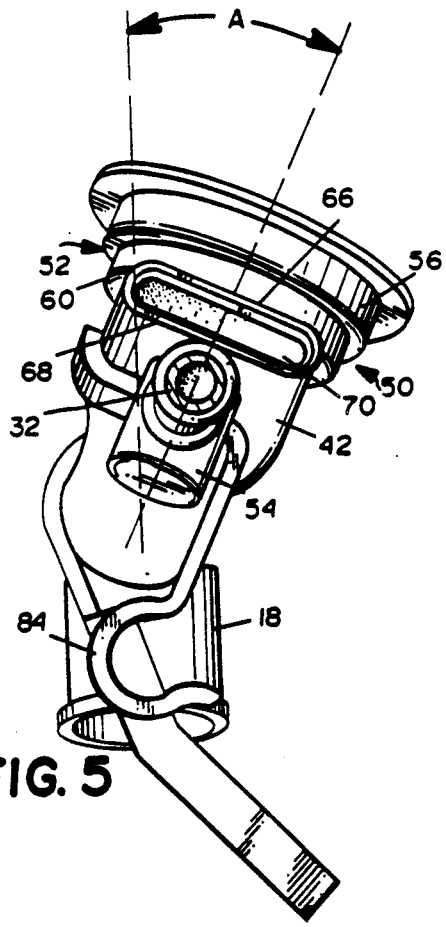
FIG. 5
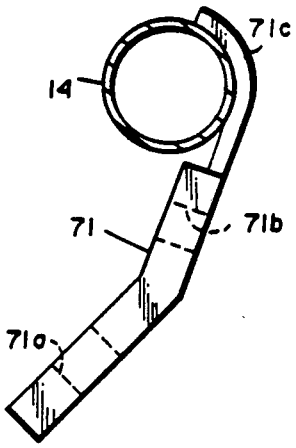
FIG. 6
FIG. 7
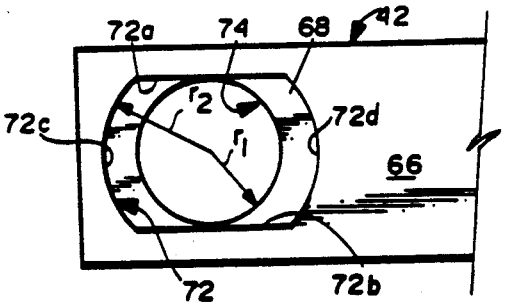
FIG. 8
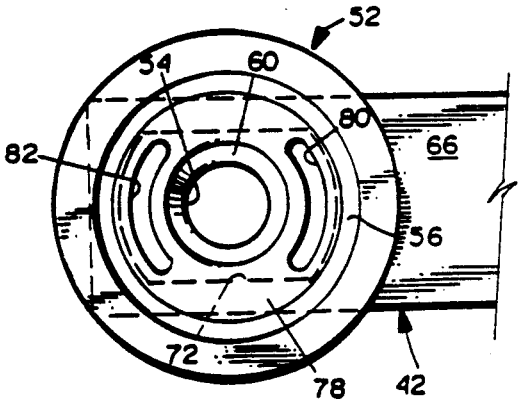

AUTOMOTIVE FUEL RAIL ASSEMBLIES WITH INTEGRAL MEANS FOR MOUNTING FUEL REGULATOR

This application is a division of application Ser. No. 07/250,056 filed Sept. 28, 1988, now U.S. Pat. No. 4,991,556.

FIELD OF THE INVENTION

The present invention generally relates to the field of internal combustion engines. More particularly, the invention relates to automotive fuel rails adapted to provide an available standby source of pressurized fuel for injectors associated with internal combustion engines. The invention is specifically embodied in a rigid fuel rail assembly having integral means adapted to mount a fuel regulator in operative association therewith.

BACKGROUND AND SUMMARY OF THE INVENTION

Fuel injected internal combustion engines have in recent years been employed by automotive manufacturers as a more fuel efficient alternative to conventional carbureted engines. Moreover, fuel injected internal combustion engines provide a more accurate means (as compared to carbureted engines) to control a variety of engine operating parameters via an on-board electronic control unit (ECU).

Fuel is typically supplied to the injectors by means of one or more rigid conduits (usually referred to as "fuel rails" in art parlance). The fuel rails are thus adapted to receiving the injectors at spaced-apart locations along the fuel rail so as to be in alignment with respective positions of the intake ports of an internal combustion engine. In such a manner, pressurized fuel from the vehicle's fuel system may be supplied to the individual injectors via the fuel rail.

Fuel pressure regulators are typically provided in the fuel circuit. The conventional fuel pressure regulators are of the "diaphragm" type and serve to maintain the fuel pressure within the fuel rail at an acceptable limit so that the proper fuel flow characteristics to and through the injectors is assured. The fuel regulator is conventionally mounted near (but separately of) the outlet of the fuel rail with suitable conduits establishing fluid communication between it and the discharge end of the fuel rail. The fuel regulator thereby serves to maintain substantially constant upstream fuel pressure within the fuel rails.

As may be appreciated, the conventional technique of separately mounting the regulator requires additional labor during engine production with a concomitant increased production cost. In addition, separate mounting of the regulator causes it to occupy valuable space in the engine compartment. Thus, the separate mounting of the fuel pressure regulator may not be spatially suited to the physical layouts of a number of engine configurations.

One known proposal for incorporating a fuel regulator integrally in a fuel rail is to fashion a recess in the fuel rail and then secure only the upper housing of the regulator (with its associated diaphragm) directly to the fuel rail to achieve an integral fuel rail/regulator assembly. The recess in the fuel rail according to this known proposal thus serves as the bottom housing for the regulator—that is, a separate lower regulator housing structure is unnecessary. While integral mounting of the regulator to the fuel rail is achieved, this prior proposal is disadvantageous in that the regulator itself cannot be calibrated and/or leak tested independently of the fuel rail (i.e., since it does not physically have a lower housing). Instead, calibration and/or leak testing can only be achieved after the regulator is integrally mounted to the fuel rail—a cumbersome, if not costly, procedure.

Therefore, what has been needed in this art, at least from an economy of labor and space point of view, is a fuel rail assembly which provides the means by which a fuel pressure regulator may be integrally operatively associated therewith, while at the same time, allow calibration and/or leak testing of the regulator independently of the fuel rail prior to assembly. It is towards achieving such advantages that the present invention is specifically directed.

According to the present invention, a fuel rail assembly is provided which includes at least one rigid tubular fuel rail for supplying fuel to a number of fuel injectors dependently positioned in fluid communication with the rail. The tubular fuel rail includes a mounting section which defines a recess for accepting a lower portion of the fuel regulator housing, and which establishes with this lower fuel regulator housing an annular chamber in fluid communication with the fuel passageway of the tubular fuel rail. The lower regulator housing moreover defines at least one aperture which fluid-connects the defined annular chamber with a fuel regulating chamber physically located within the fuel pressure regulator. Hence, fuel may flow into the regulator from the fuel rail via the defined annular chamber, whereby the pressure of the fuel within the fuel rail may be regulated.

The mounting section of the fuel rail assembly according to this invention is, in a preferred embodiment, generally rectangular in cross-sectional geometry so as to provide substantially planar upper and lower wall regions. The upper and lower wall regions respectively define upper and lower separated (but preferably coaxially registered) apertures and are collectively adapted to receive a tail section of a fuel regulator mounting cup.

The regulator mounting cup includes an upper cup section which is rigidly connected to, and supported by, the upper wall of the mounting section and defines a number of arcuately shaped openings therethrough. These defined openings are in registry with a portion of the upper aperture and thus establish, collectively with the upper aperture, a fluid flow path from the tubular fuel rail to the cup section of the regulator mounting cup. The fuel then enters the fuel regulator (through openings in the regulator's lower housing) and is discharged from its outlet into the regulator mounting cup's tail section. An outlet nipple in fluid communication with this tail section then directs the fuel to the return side of the vehicle's fuel system.

Other aspects and advantages of this invention will become more clear after careful consideration is given to the detailed description of the preferred exemplary embodiments thereof which follows.

BRIEF DESCRIPTION OF THE ACCOMPANYING DRAWINGS

Reference will hereinafter be made to the accompanying drawings wherein like reference numerals throughout the various FIGURES denote like structural elements, and wherein;

FIG. 5 is an end elevational view of the fuel rail shown in FIG. 3 as taken along line 5—5 therein;

FIG. 6 is a cross-sectional elevational view of a representative mounting flange employed in this invention to mount the fuel rail assembly to an internal combustion engine;

FIG. 7 is a top plan view of the integral means for mounting the fuel regulator as taken along line 7—7 in FIG. 4;

FIG. 8 is a top plan view of another portion of the integral means for mounting the fuel regulator as taken along line 8—8 in FIG. 4;

DETAILED DESCRIPTION OF THE PREFERRED EXEMPLARY EMBODIMENTS

Figure 1:
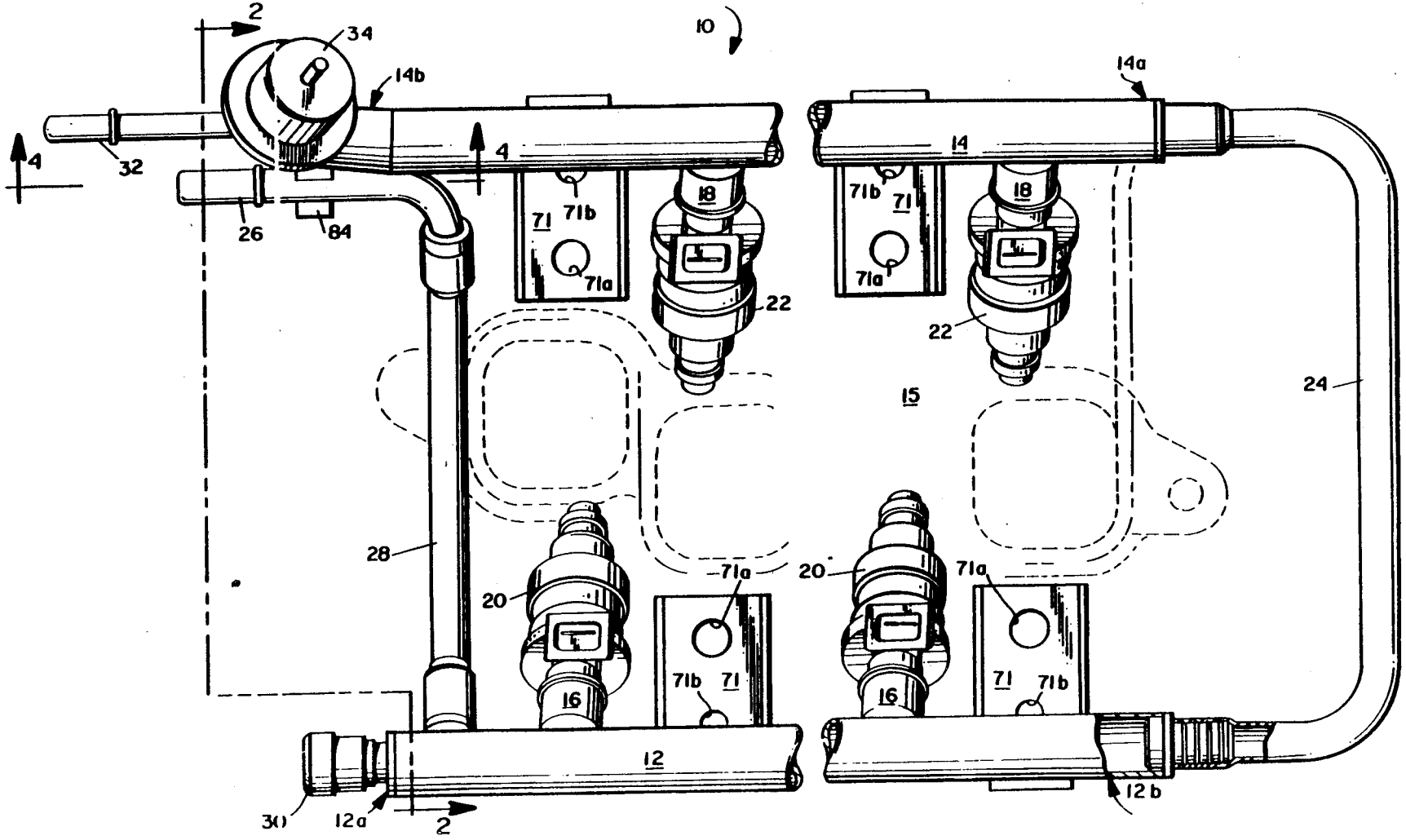
FIG. 1 is a top plan view of an exemplary fuel rail assembly according to this invention.
Figure 2:
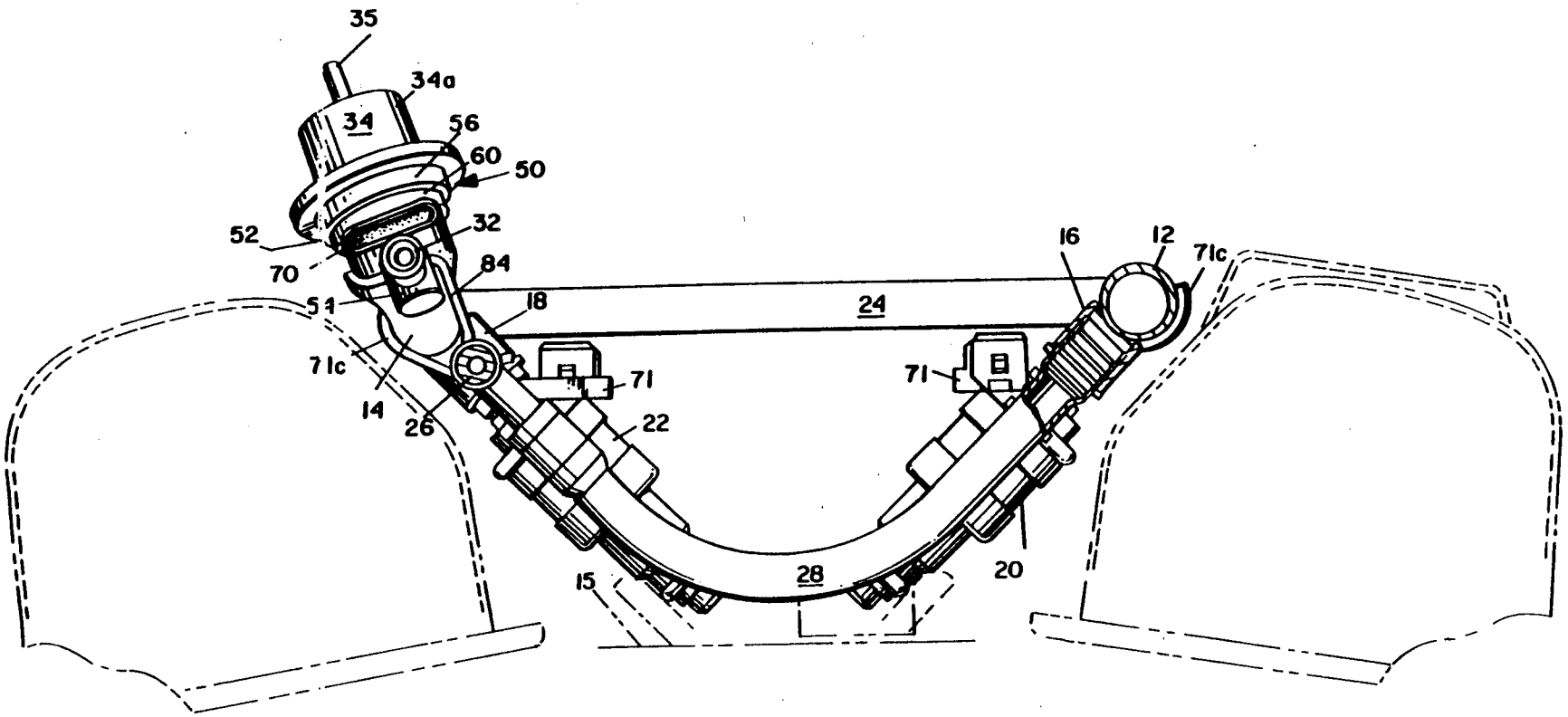
FIG. 2 is an end elevational view of the fuel rail assembly shown in FIG. 1 as taken along line 2—2 therein.

An exemplary assembly 10 according to this invention is shown in accompanying FIGS. 1 and 2 as including a pair of rigid elongate tubular fuel rails 12 and 14 in operative association with an internal combustion engine 15 (only a portion of which is visible in FIGS. 1 and 2 for clarity of presentation). Each of the fuel rails 12 and 14 include generally dependant, angularly oriented injector cups 16 and 18 for receiving a selected number (e.g., in dependance upon the number of engine cylinders to be serviced) of fuel injectors 20 and 22, respectively.

Each of the fuel rails include inlet and outlet ends 12*a*, 12*b* and 14*a*, 14*b*, respectively. Fluid connection between the two fuel rails 12, 14 is established by means of a rigid (or flexible) generally U-shaped conduit 24. Moreover, an inlet nipple 26 is fluid connected to the inlet end 12*a* of fuel rail 12 via a rigid (or flexible) conduit 28. The inlet end 12*a* of fuel rail 12 is closed by means of a diagnostic fitting 30 which serves to permit monitoring of the pressure which exists within the fluid circuit collectively established by the fuel rails 12 and 14, and their associated conduits 24 and 28.

As will be appreciated, fuel is supplied to the inlet nipple 26 from the vehicle's fuel pump (not shown) and then is directed sequentially through conduit 28, fuel rail 12, conduit 24 and fuel rail 14 (i.e., in generally a counterclockwise flow pattern as viewed in FIG. 1) so as to provide a standby source of pressurized fuel for the injectors 20, 22. Fuel then exits fuel rail 14 via outlet nipple 32 after first flowing through the fuel pressure regulator 34 as will be discussed in greater detail below. The regulator 34 is communicates with the intake manifold vacuum via a conduit (not shown) coupled to a nipple 35 associated with the regulator's upper housing 34*a*.

Figure 3:
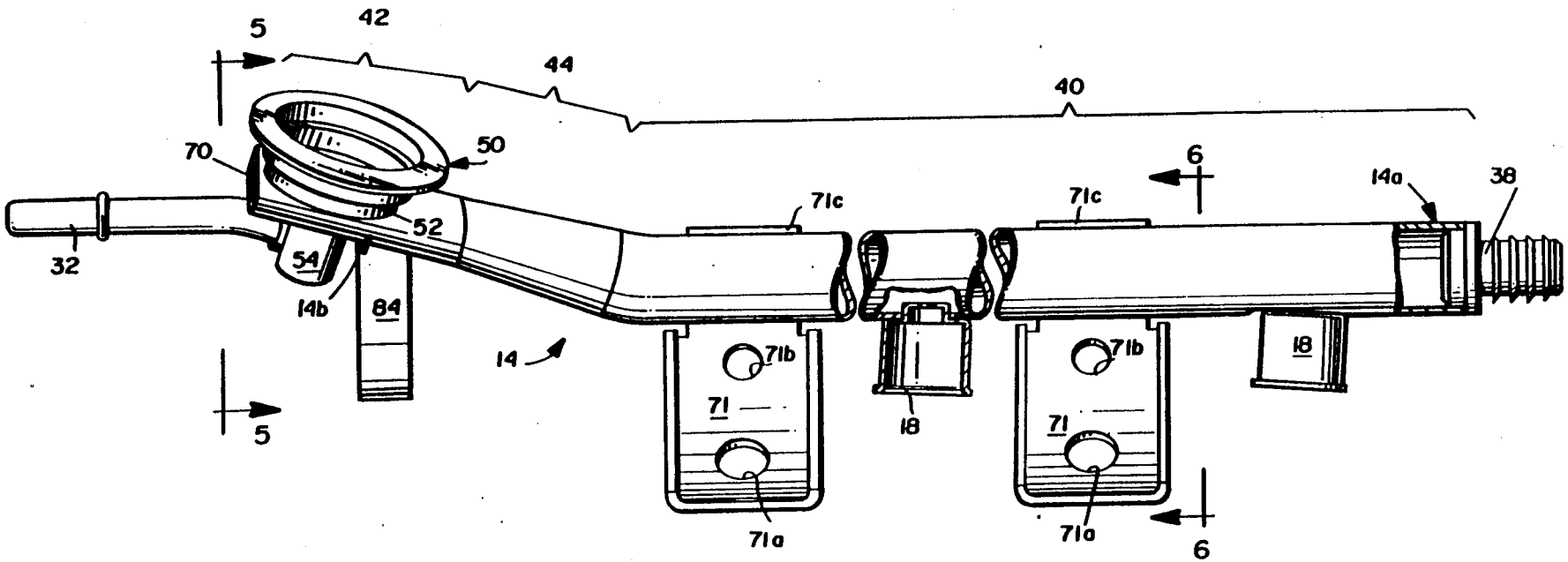
FIG. 3 is a side elevational view of a fuel rail of this invention particularly showing the integral means for mounting a fuel regulator.

The fuel rail 14 according to this invention is shown more clearly in accompanying FIG. 3. As is seen, the inlet end 14*a* of fuel rail 14 is closed by means of a nipple 38 which fluid connects the fuel rail 14 with the conduit 24 (see FIGS. 1 and 2). As fuel flows from the inlet end 14*a* towards the outlet end 14*b*, it will thus be presented to the injector cups 18 in fluid communication with the generally cylindrical interior of fuel rail 14.

The fuel rail 14 is generally composed of a tubular primary section 40, a mounting section 42 and a transition section 44 integrally interposed between the primary and mounting sections 40, 42, respectively. A mounting cup 50 is rigidly associated (e.g., via soldering, brazing or the like) with the mounting section 42 and defines a recess adapted to receiving the fuel pressure regulator 34 therein. The fuel pressure regulator may be removably fixed to the cup section 50 by any suitable means not shown, for example, bolts, clips, or the like, or may be rigidly fixed thereto via soldering or brazing.

Figure 4:
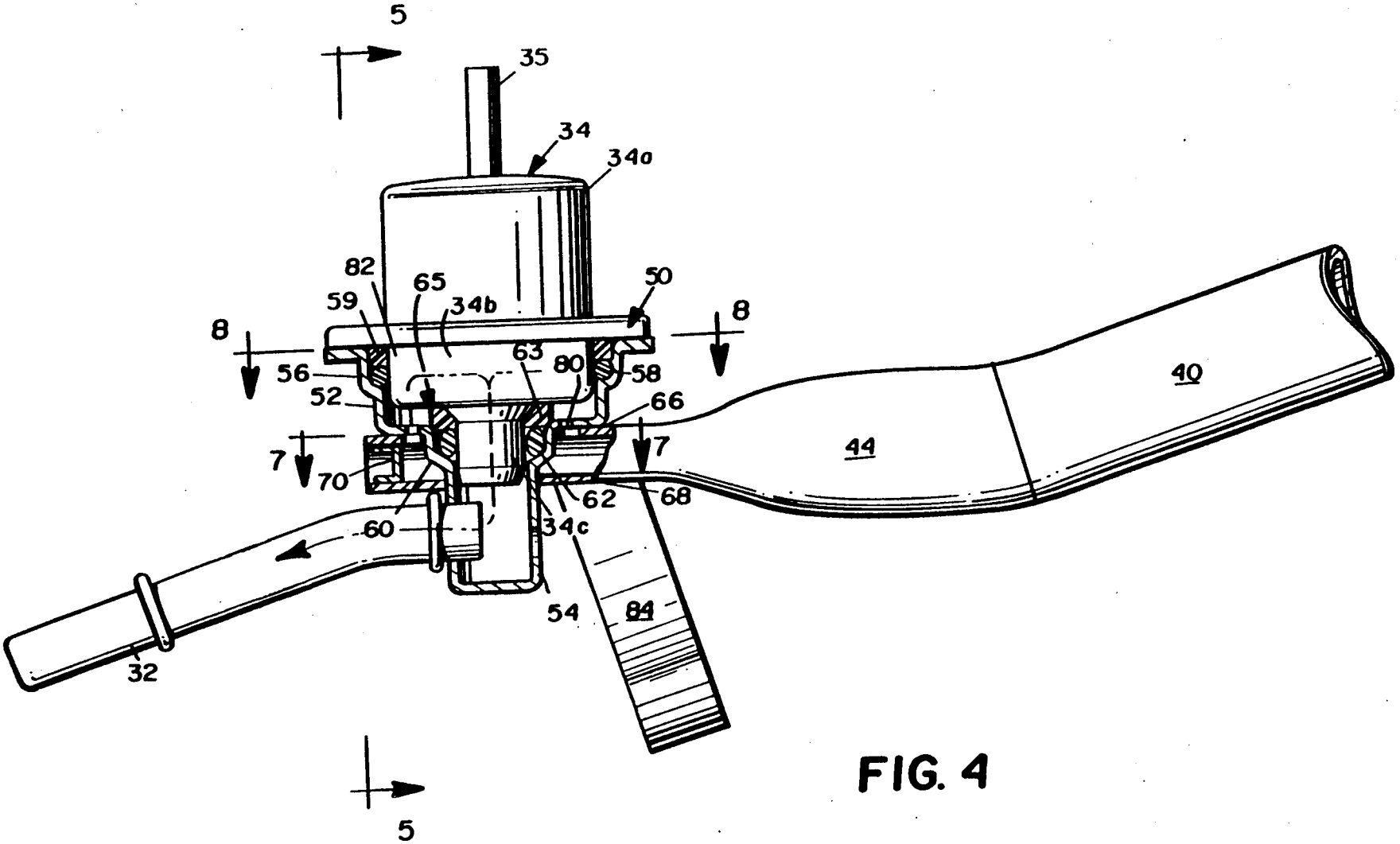
FIG. 4 is a cross-sectional elevational view taken along line 4—4 in FIG. 1.

As is perhaps more clearly shown in FIG. 4, the mounting cup 50 includes an upper cup section 52 fixed to (and supported by) the mounting region 42 of fuel rail 14 and a lower tail section 54, these two sections 52 and 54 being in open communication with one another when the fuel pressure regulator 32 is absent.

The cup section 52 includes an annular lip 56 which receives an elastomeric O-ring seal 58 and thus provides a seal between the cup section 52 and a lower housing portion 34*b* of the fuel pressure regulator 34 to prevent fuel leakage to the ambient environment. The O-ring seal 58 is itself seated against a substantially rigid plastic (or metal) back-up ring 59. The back-up ring 59, in essence, provides an effective seat against which the O-ring seal 58 bears, and thus provides the means collectively with the O-ring seal 58 for effectively sealing the lower housing portion 34*b* and the cup section 52 against fuel leakage therebetween.

The tail section 54, on the other hand, includes an annular lip 60 which provides a lower seat for an elastomeric O-ring seal 62. A rigid plastic (or metal) back-up ring 63 is located adjacent the lower housing portion 34*b* and surrounds the tail section 54 to thereby provide an upper seat against which the O-ring 62 bears so as to establish an effective seal between the tail housing 34*b* of fuel pressure regulator 34 and the tail section 54 of the mounting cup 50. As will be appreciated, the seal established by means of O-ring 62 also effectively fluid-isolates the cup section 52 from the tail section 54 when the fuel pressure regulator 34 is operatively present—that is, the annular chamber 65 defined between the cup section 52 and the lower housing portion 34*b* of regulator 34 is fluid isolated from the interior of the tail section 54.

The mounting region 42 is comprised of planar, parallel upper and lower wall sections 66, 68, respectively, which thereby establish a generally rectangular cross-sectional geometry. A gradual transition between the cylindrical cross-section of primary section 40 and the generally rectangular cross-section of mounting region 42 is provided by transition section 44. As is seen in FIG. 5 the transition section 44 also orients the mounting cup 50 relative to the general elongate axis of the fuel rail 14 by an angle A, which, in the preferred embodiment, just happens to be 25°. This angular orientation ensures that the mounting cup 50 (and hence the fuel pressure regulator 34) is mounted onto the engine 15 free of surrounding structures. The terminal end of the mounting section 42 is closed via an end plug 70 soldered, brazed or otherwise rigidly connected thereto.

The fuel rails 12 and 14 are each rigidly coupled to the engine 15 via mounting brackets 71 which define suitable apertures 71*a* and 71*b* for receiving bolts and thus securing the rails to the engine 15. Each of the brackets 71 includes an upper section 71*c* which is arcuately shaped so as to be capable of being rigidly coupled (e.g., via soldering) to the rails 12 and 14. Accompanying FIG. 6 shows a bracket 71 attached to the rail 14, and is also representative of the manner in which respective ones of the brackets 71 are attached to the fuel rail 12.

As is seen more clearly in FIG. 7, the mounting section 42 of fuel rail 14 includes upper and lower coaxially registered openings 72 and 74 respectively defined in the upper and lower walls 66 and 68. The lower opening is generally cylindrical and has a radius $r_1$. The upper opening, however, is elongate and is defined by a pair of parallel sides 72*a*, 72*b* spaced apart by a dimension generally equal to $2r_1$, and an opposing pair of convexly arcuate ends 72*c*, 72*d* having a radius $r_2$ greater than the radius $r_1$ of lower opening 74.

The lower wall 78 of the cup section 52 defines a pair of arcuate apertures 80 and 82 as can be best seen in FIG. 8. These arcuate apertures 80 and 82 are located interiorly (i.e., towards the common axis of openings 72 and 74) of the arcuate ends 72*c*, 72*d* of upper opening 72. Thus, fluid communication between the fuel rail 14 and the annular chamber 65 is established by virtue of the registered communication between the apertures 80, 82 in the cup section's lower wall 78 and the upper opening 72 defined in the upper wall of the mounting section 42.

In use therefore, fuel will flow along the fuel rail 14 from its inlet end 14*a* towards its outlet end 14*b* and will enter the annular chamber 65 in the interior of the cup section 52 due to the communication established by the registry between the apertures 80, 82 and the upper opening 72. The fuel which is directed into the annular chamber 65 then enters the housing 34*b* of fuel pressure regulator via openings (not shown) which are defined thereby. The fuel is discharged from the fuel pressure regulator 34 through the end of its housing tail portion 34*c* and thus enters the interior of the tail section 54 of the regulator mounting cup 50. Thereafter, fuel may be returned to the vehicle's fuel system via a suitable conduit connected to the outlet nipple 32 in fluid communication with the interior of tail section 54. The fuel flow path just described above is schematically shown in FIG. 4 by the double-dash chain line.

The fuel rail assembly 10 according to this invention also provides close physical relationship as between the inlet and outlet nipples 26 and 32, respectively. In this regard, the conduit 28 is provided so as to bring the inlet nipple closely adjacent the outlet nipple 32. The inlet nipple 26 is supported via a clip member 84 which is rigidly associated with the mounting section 42 of fuel rail 14 and thus maintains the close physical relationship as between the inlet and outlet nipples 26 and 32, respectively.

This close physical relationship as between the inlet and outlet nipples 26 and 32, respectively, facilitates fluid interconnection to conduits associated with components of the vehicle's fuel system (e.g., the fuel tank and/or fuel pump). Thus, during assembly line manufacture of a vehicle which includes the fuel rail assembly 10 of this invention, savings in terms of labor economy may be realized due to this close physical relationship as between the inlet and outlet nipples 26 and 32, respectively.

Figure 9:
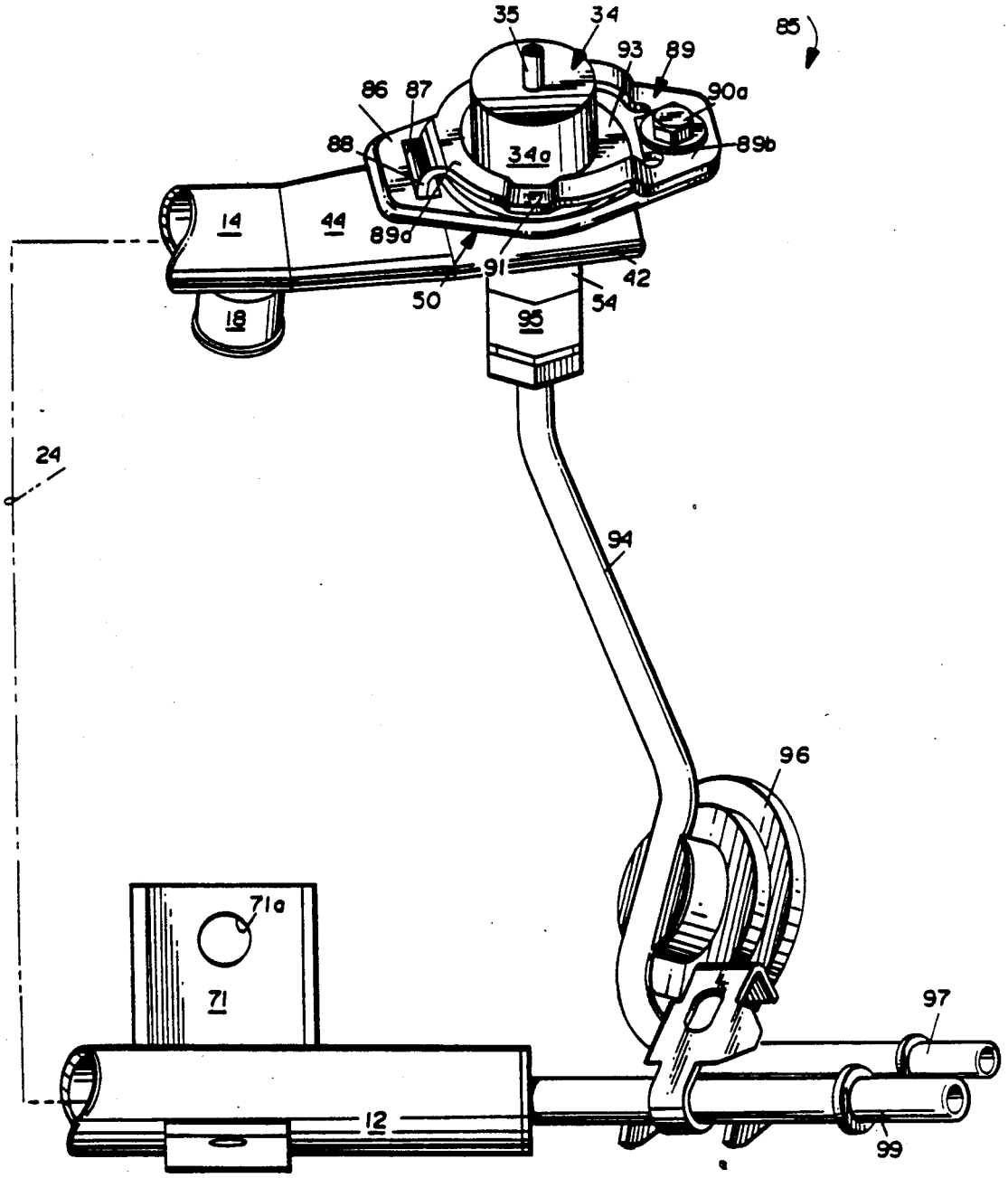
FIG. 9 is a partial plan view of another fuel rail assembly according to this invention.
Figure 10:
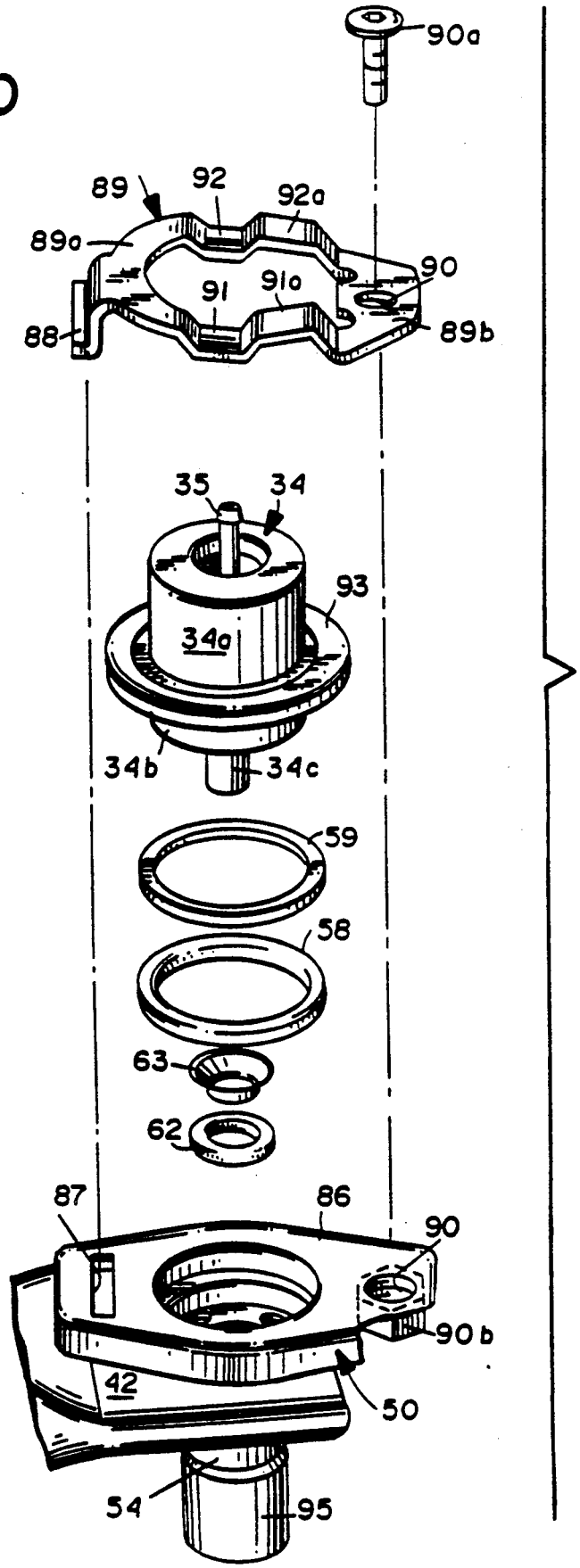
FIG. 10 is an exploded perspective view of the integral fuel pressure regulator mounting means employed in the embodiment shown in accompanying FIG. 9.

Another embodiment of a fuel rail assembly 85 according to this invention is shown in accompanying FIGS. 9 and 10. The fuel rail assembly shown in FIGS. 9 and 10 is generally similar to the embodiment of the fuel rail assembly 10 described above with reference to FIGS. 1–8 and, therefore, like structural elements as between these two embodiments retain the same reference numerals. The assembly 85 principally differs from assembly 10, however, in the means which couple the fuel pressure regulator 34 to the mounting cup 50.

As is seen in FIGS. 9 and 10, the mounting cup 50 includes an elongate upper mounting flange 86 which defines a slot 87. The slot 87 is sized and configured to receive a downwardly and outwardly bent tongue 88 unitarily associated with an end 89*a* of a mounting collar 89. The end 89*b* of mounting collar 89 opposite to its tongue 88 defines an aperture 90 (see FIG. 10) through which a bolt 90*a* passes and engages the threads of a nut 90*b* rigidly associated with the underside of the flange 86. The collar 89 thus bounds the upper housing 34*a* of the fuel pressure regulator 34 and unitarily includes a pair of downwardly directed feet 91, 92 which bear against the housing flange 93 of the fuel pressure regulator 34.

The feet 91, 92 are connected to end 86*b* of collar 89 via upwardly directed bridge members 91*a*, 92*a*, respectively. When the collar 89 is in use (i.e., with the tongue coupled to the slot 87 defined in the mounting flange 89 and the bolt 90*a* threadably coupled to the nut 90*b* through the aperture 90), the feet will be urged via the spring-like functions provided by means of the bridge members 91*a*, 92*a* into bearing engagement with the housing flange 93. Thus, the mounting collar 89 serves to positionally retain the fuel pressure regulator 34 within the mounting cup 50, while yet permitting the regulator to be removed therefrom for replacement and/or servicing.

The tail section 54 of mounting cup 50 is fluid connected to a rigid (or flexible) conduit 94 via a coupling member 95. The conduit 94 passes the fuel to an absorber 96 (which serves to absorb pressure pulses within the fuel circuit) and is then discharged through discharge nipple 97. It will be observed that the supply and discharge nipples 99 and 97, respectively, are physically close to one another so as to facilitate interconnection to the vehicle's fuel system as was described previously.

Figure 11:
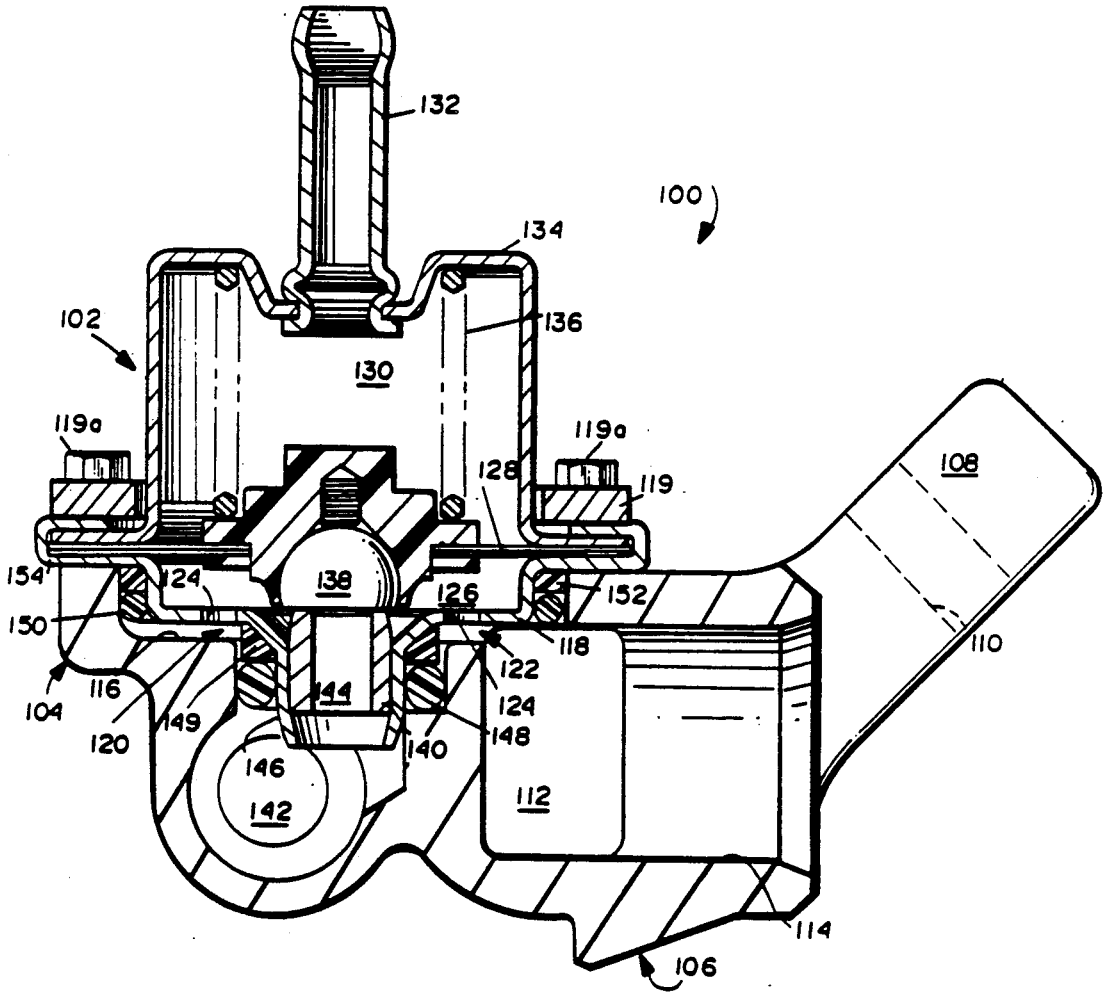
FIG. 11 is cross-sectional elevational view of another embodiment of the integral fuel rail and regulator assembly according to this invention.

FIG. 11 shows in cross-sectional elevational view another embodiment of a fuel rail assembly 100 according to this invention. As is seen, the assembly 100 is generally comprised of a fuel pressure regulator 102 integrally coupled to a mounting section 104 unitarily formed at a predetermined location on fuel rail 106. The fuel rail 106 may have one or more mounting brackets 108 which define an aperture 110 for accepting a suitable bolt (or like means) to thus secure the assembly 100 to surrounding structure (e.g., the engine block).

It will be understood that the fuel rail 106 is elongate (i.e., extending out of the plane of FIG. 11). Thus, the fuel rail 106 defines an elongate central passageway 112 in fluid communication with an integral injector cup 114 so as to maintain an available standby supply of pressurized fuel to an injector (not shown) operatively received within the injector cup 114. It should be noted here that, in use, the orientation of the assembly 100 will be such that the injector cup 114 (and hence the injector) will be oriented angularly downwardly towards the intake port of the engine and, therefore, the fuel pressure regulator 102 will likewise be angularly oriented as compared to that shown in FIG. 11. However, for ease of discussion and understanding, the assembly 100 is shown in FIG. 11 with the fuel pressure regulator 102 oriented along a vertical axis.

The mounting section 104 of the fuel rail 106 defines a recess 116 for receiving the high pressure side (bottom) housing 118 of the fuel pressure regulator 102. The entire regulator 102 is fixed to the mounting section 104 via an annular mounting collar 119 and its associated bolts 119*a*. An annular chamber 120 (in fluid communication with the central passageway 112 of the fuel rail 106 via entrance channel 122) is therefore defined between the bottom of recess 116 and the housing 118. The bottom housing 118 itself defines apertures 124 which establish communication between the annular chamber 120 and the high pressure chamber 126 established by means of the regulator diaphragm 128 and the bottom housing 118. Fuel may thus enter the defined annular chamber 120 and then flow into the high pressure chamber 126 via apertures 124.

The diaphragm 128 of regulator 102 separates and isolates the high pressure chamber 126 from the low pressure chamber 130, the latter being in communication with the engine manifold vacuum via a conduit connected to the nipple 132 associated with the low pressure side (upper) housing 134. A compression spring 136 is contained within the upper housing 134 and exerts a bias force against the diaphragm 128 in a direction which urges the valve element 138 into seated relationship with the valve port element 140. As is well known, the valve element 138 will unseat against the bias force of spring 136 under influence of the pressurized fuel flowing into the high pressure chamber 126. In such a manner, the fuel pressure upstream of regulator may be regulated via the diaphragm 128. The fuel may then be discharged from the high pressure chamber 126 into an outlet passageway 142 via discharge port 144 defined by the valve port element 140.

It will be observed in FIG. 11 that the valve port element 140 is rigidly received within a tail section 146 of lower housing 118. An elastomeric O-ring seal 148 is provided so as to seal the tail section 146 and the recess 106 against fuel leakage directly into the discharge passageway 142 from the annular chamber 120. Hence, seal 148 fluid-isolates the annular chamber 120 and the discharge passageway 142.

The seal 148 is seated against an annular back-up ring 149 surrounding the tail section 146 adjacent the bottom housing 118. The bottom housing 118 is sealed against fuel leakage to the ambient environment via an elastomeric O-ring seal 150 surrounding the bottom housing 118 above the established annular chamber 120. This O-ring seal 150 is seated against an upper annular back-up ring 152 which is disposed between the O-ring seal 150 and the flange 154 of the regulator housing. In such a manner, the back-up rings 149 and 150 provide a seat for O-ring seals 148 and 150, respectively, thereby allowing effective seals to be formed against fuel leakage.

The structures shown in FIG. 11 thus allow the regulator 102 to be integrally mounted to the mounting section 104 of the assembly 100, while still allowing the fuel regulator 102 to be calibrated and/or leak tested prior to its mounting. It will be understood that, although the structures shown in FIG. 11 (and the other FIGURES discussed previously) have been described in connection with a rigid tubular metal fuel rail, the structures and their attendant functions could equally be employed with rigid plastic fuel rails as may be desired by the automotive designer.

As can now be appreciated, the present invention provides fuel rails which contribute to economy of space and labor (i.e., since the fuel pressure regulator is capable of being an integral part thereof). However, while the invention has been described in connection with what is presently considered to be the most practical and preferred embodiments, it is to be understood that the invention is not to be limited to the disclosed embodiment. Instead, the invention is intended to cover various modifications and equivalent arrangements included within the spirit and scope of the appended claims.

What is claimed is:

1. In combination: a cup having an opening bounded by a flange, a fuel pressure regulator comprising a housing that is bounded by a flange, said fuel pressure regulator being disposed within said cup to place said housing flange in overlaying juxtaposition to said cup flange, and means to hold said housing flange in the aforestated juxtaposition to said cup flange comprising a clamp means, means positively defined on both said cup and said clamp means coacting to pivotally mount said clamp means on said cup so as to allow said fuel pressure regulator to be inserted into said cup and thereafter said clamp means to pivot to a clamping position holding said housing flange in juxtaposition to said cup flange, and fastening means fastening said clamp means to said cup to hold said clamp means in said clamping position, wherein said means coacting to pivotally mount said clamp means on said cup comprises a slot in one of said cup flange and said clamp means and a tongue on the other of said cup flange and said clamp means, said tongue being disposed in said slot.

2. In combination: a cup having an opening bounded by a flange, a fuel pressure regulator comprising a housing that is bounded by a flange, said fuel pressure regulator being disposed within said cup to place said housing flange in overlaying juxtaposition to said cup flange, and means to hold said housing flange in the aforestated juxtaposition to said cup flange comprising a clamp means, means positively defined on both said cup and said clamp means coacting to pivotally mount said clamp means on said cup so as to allow said fuel pressure regulator to be inserted into said cup and thereafter said clamp means to pivot to a clamping position holding said housing flange in juxtaposition to said cup flange, and fastening means fastening said clamp means to said cup to hold said clamp means in said clamping position, wherein said fastening means and said means coacting to pivotally mount said clamp means on said cup are respectively disposed to diametrically opposite sides of said fuel pressure regulator.

3. A fuel rail assembly comprising, in combination, a tubular fuel rail, and mounting means for integrally mounting a fuel pressure regulator of the type having a housing and a housing flange in operative association with said fuel rail, said mounting means including:

a mounting cup for receiving a portion of said fuel pressure regulator housing;

said mounting cup having a mounting flange for supporting said fuel pressure regulator housing flange;

mounting collar means removably coupled to said mounting flange for capturing portions of said fuel pressure regulator housing flange between said mounting collar means and said mounting flange, wherein said fuel pressure regulator is integrally and removably coupled to said tubular fuel rail; and wherein said mounting collar means includes a downwardly and outwardly bent tongue, and wherein said mounting flange defines a slot for receiving said tongue.

4. A fuel rail assembly as in claim 3, wherein said mounting collar means includes at least one pair of bearing feet, and means for urging said feet into bearing engagement with said portions of said fuel pressure regulator housing flange, whereby said housing flange portions are captured between said bearing feet and said mounting flange.

5. The combination set forth in claim 1 wherein said slot is in said cup flange and said tongue is on said clamp means.

* * * * *